United States Patent [19]

Inkpen et al.

[11] 4,404,151

[45] Sep. 13, 1983

[54] DOWN-DRAFT CARBURETOR

[75] Inventors: Terence Inkpen, Chelmsford; Frank T. Newbury, Great Dunmow, both of England

[73] Assignee: Ford Motor Company, Dearborn, Mich.

[21] Appl. No.: 270,532

[22] PCT Filed: Aug. 15, 1979

[86] PCT No.: PCT/US79/00613

§ 371 Date: Apr. 18, 1980

§ 102(e) Date: Apr. 18, 1980

[87] PCT Pub. No.: WO80/00470

PCT Pub. Date: Mar. 20, 1980

[30] Foreign Application Priority Data

Aug. 19, 1978 [GB] United Kingdom ..... 33965/78

[51] Int. Cl.[3] ..... F02M 9/06

[52] U.S. Cl. ..... 261/44 C; 261/44 F

[58] Field of Search ..... 261/44 C, 44 F, 44 B, 261/50 A, 34 R

[56] References Cited

U.S. PATENT DOCUMENTS

| | | | |
|---|---|---|---|
| T962,010 | 9/1977 | Newbury et al. | 261/44 F |
| 1,666,296 | 4/1928 | Monosmith et al. | 261/50 A |
| 2,078,849 | 4/1937 | Grosjean | 261/50 A |
| 2,991,052 | 7/1961 | Carlson et al. | 261/DIG. 39 |
| 2,996,051 | 8/1961 | Mick | 261/50 A |
| 3,023,744 | 3/1962 | Mick | 261/50 A |
| 3,105,861 | 10/1963 | Korte | 261/41 D |
| 3,169,599 | 2/1965 | Marsee et al. | 261/DIG. 39 |
| 3,322,408 | 5/1967 | Stoltman | 261/50 A |
| 3,471,132 | 10/1969 | Sullivan | 261/50 R |
| 3,592,449 | 7/1971 | Elgohary | 261/50 A |
| 3,682,449 | 8/1972 | Severn | 261/62 |
| 3,897,765 | 8/1975 | Harrison et al. | 261/44 F |
| 3,957,930 | 5/1976 | Birmingham | 261/44 B |
| 4,034,029 | 7/1977 | Tipton | 261/44 F |

FOREIGN PATENT DOCUMENTS

| | | | |
|---|---|---|---|
| 2456920 | 6/1975 | Fed. Rep. of Germany | 261/44 F |
| 2503848 | 5/1976 | Fed. Rep. of Germany | 261/50 A |

*Primary Examiner*—Tim R. Miles

*Attorney, Agent, or Firm*—Robert E. McCollum; Clifford L. Sadler

[57] ABSTRACT

A variable venturi down-draft carburetor comprises a one-piece unitary casting that defines an induction passage and upwardly open cavities constituting a float chamber and a recess in which a movable venturi member is housed. A throttle valve, main fuel jet, and venturi member are all housed wholly within the confines of the casting, and the casting is covered by a single plate that closes the upwardly open cavities and defines an air inlet orifice to the induction passage. By housing the throttle valve, main jet and venturi in one unit, operation of the carburetor is unaffected by variations in the cover plate produced by manufacturing tolerances. Access to the interior of the carburetor is achieved simply by removal of the plate, which does not, in itself, affect the adjustment of the carburetor. The casting preferably includes integral mountings for a vacuum motor, and/or acceleration pump, and/or an automatic choke.

1 Claim, 10 Drawing Figures

DOWN-DRAFT CARBURETOR

DESCRIPTION

This invention relates to down-draft carburetors.

U.S. Pat. No. 3,897,765 discloses a down-draft carburetor of the variable venturi type which comprises a downwardly extending induction passage, a throttle valve mounted in the induction passage, a float chamber, a main jet for conduction fuel from the float chamber into the induction passage, a movable member mounted for transverse movement out of a recess in one side of the induction passage towards the main jet, the movable member cooperating with the main jet and the adjacent walls of the induction passage to define a venturi of variable cross-sectional area in the induction passage upstream from the throttle valve, a metering needle carried by the movable member engaging with the main jet to control the flow of fuel therethrough, and a vacuum motor for moving the movable member.

Hitherto, housings for such carburetors have been formed from a number of individual components, all of which require separate machining or casting, and separate assembly operations prior to the final assembly of the carburetor. The effective functioning of a carburetor depends very closely upon the accuracy with which the moving parts and flow passages within the carburetor cooperate with each other. For example, a minor misalignment of the movable member relative to the induction passage may restrict or hinder its movement and therefore prevent effective operation of the carburetor. The components of the carburetor must therefore be manufactured to fine tolerances to ensure effective and consistent performance of the carburetor. Where two cooperating parts of the carburetor are manufactured in separate sub-assemblies, the two sub-assemblies must be machined to even finer tolerances so that the variations in size and alignments occuring during separate manufacture and assembly of the two sub-assemblies are not so great as to produce an unacceptably large variation in size between the two cooperating parts of the carburetor when the sub-assemblies are assembled together. The construction of a carburetor from a number of separate sub-assemblies therefore necessitates careful manufacturing and assembly techniques all of which increase the cost of production of the carburetor.

Moreover, in the known carburetors of this type, access to the interior of the carburetor usually involves removal of one or more of the sub-assemblies. Consequently, the adjustment of the carburetor can be inadvertently disturbed even during a routine visual examination of the interior of the carburetor.

In accordance with this invention, we provide a down-draft carburetor of the variable venturi type in which the main jet, the throttle valve and the movable member are all mounted wholly within the confines of a unitary casting which defines the induction passage and upwardly open passages constituting the float chamber and the recess, and in which the unitary casting is covered by a single plate which closes the said upwardly open cavities and defines an inlet orifice to the induction passage.

By providing a single casting which completely houses the main jet, throttle valve and movable member, all the machining operations necessary for the mounting of these parts in the carburetor are effected on a single part. Moreover, since the cover plate serves simply as a closure for the cavities in the cover casting, variations in the size of the cover plate due to manufacturing tolerances have little or no effect on the operation of the parts housed in the casting. The carburetor can therefore be manufactured with accuracy and reproducible performances more easily than the known carburetors of the same type.

In addition, access to the interior of the carburetor is achieved simply by removing the single closure plate. Servicing or repair of the carburetor is therefore simplified, since removal of the closure plate does not necessitate adjustment of any of the moving parts of the carburetor and cannot, in itself, disturb the adjustment of the carburetor.

In order to facilitate servicing of the carburetor even further, the main jet is preferably incorporated in a jet block removably mounted in an upwardly open cavity in the casting positioned between the induction passage and the cavity defining the float chamber.

The construction of the carburetor can be further simplified if the casting also defines an integral mounting for the vacuum motor. In the preferred embodiment of the invention, this mounting is positioned alongside the recess for the movable member, and the movable member is mounted on a layshaft extending transversely through the casting, the vacuum motor acting directly upon the layshaft. This arrangement results in a compact configuration of the carburetor.

Desirably, mountings for an automatic choke mechanism and/or an acceleration pump are also formed integrally with the casting, thus further reducing the number of component parts of the carburetor.

A preferred embodiment of a carburetor constructed in accordance with the invention will now be described, by way of example only, with reference to the drawings, in which.

Figure 1:
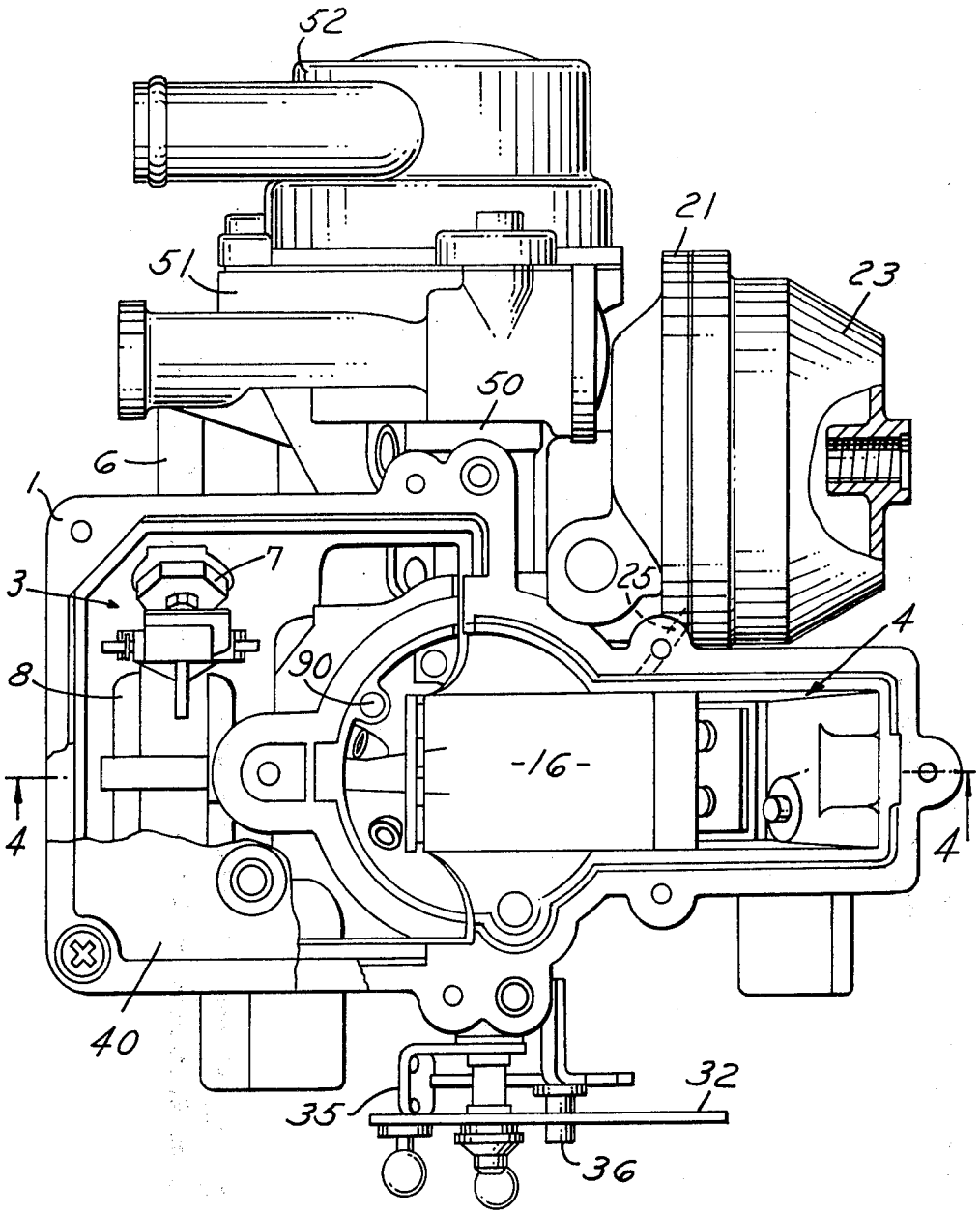
FIG. 1 is a plan view of the carburetor with parts of its closure or cover plate broken away.

Referring to the drawings, the carburetor comprises a main housing 1 that is formed as a unitary casting. The housing 1 defines an induction passage 2, (see FIG. 4) that extends downwardly through the casting, and two upwardly-open cavities 3 and 4 on opposite sides of the induction passage 2.

The first cavity 3 constitutes a float chamber and receives fuel via an inlet 6 (FIG. 1). The flow of fuel through the inlet 6 is controlled by a valve assembly 7 that is operated by a float 8 pivotally mounted on the valve assembly.

A main jet block 9 (FIG. 4) is mounted in the housing in an upwardly opening recess 10 with wall separating the induction passage 2 and the cavity 3 of the float chamber. The jet block 9 includes a fuel inlet supply pipe 11, which is normally immersed in fuel, and two main fuel jets or orifice type nozzles 12, 13, which are located in a horizontal bore 14 adjacent the wall of the induction passage 2.

The second cavity 4 houses a pivotally movable venturi member 15. The venturi member 15 comprises a vane or valve member 16 which is generally rectangular in plan, (FIG. 1) and a stem 17 which is mounted on one end of a layshaft 18 extending transversely through the casting 1, the valve 16 and the stem 17 being formed as an integral casting. Rotation of the layshaft 18 (FIG. 5) about its axis causes the valve 16 of the venturi member to pivot into and out of the induction passages towards and away from the jet block 9. Movement of the valve 16 may be facilitated by a coating of fluorinated hydrocarbon polymer, not shown. A fuel metering needle 19 is pivotally mounted in the valve 16 of the venturi member 15 and projects from the venturi member to be received in the jets 12, 13.

As best seen in FIG. 1, the region of the induction passage 2 adjacent the venturi member 9 is of rectangular shape and conforms to the shape of the valve 16. The valve 16, jet block 9 and the walls of the induction passage 2 thus define a venturi at the jets 12, 13, the cross-sectional area of the venturi varying with the position of the venturi member 15.

Figure 5:
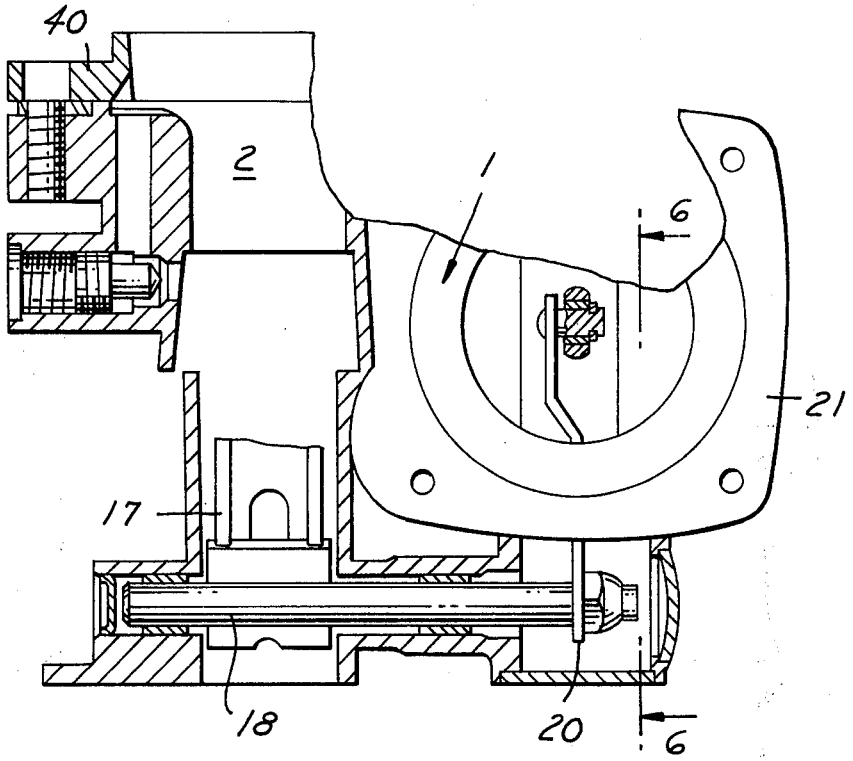
FIG. 5 is a vertical cross-sectional view taken along line 5—5 of FIG. 3.

Referring to FIG. 5, the other end of the layshaft 18 carries an arm 20 (see also FIG. 6) that extends vertically upwardly into a flanged mounting 21 (see also FIG. 1) formed integrally with the housing 1. A vacuum motor 23 (FIG. 1) of conventional construction is secured to the mounting 21 and is arranged to rotate the arm 20, and therefore the layshaft 18, about the axis of the layshaft in response to variation in the pressure in the cavity 4. The variation in pressure is communicated to the vacuum motor along a passage 25 (FIG. 1) extending through the housing 1 into the mounting 21.

Access to the layshaft 18 is gained through an aperture 19 (FIG. 2) in the base of the housing 1. In use, this aperture is sealed by a gasket (not shown) which extends between the base of the housing 1 and the engine manifold in which the carburetor is mounted.

Figure 3:
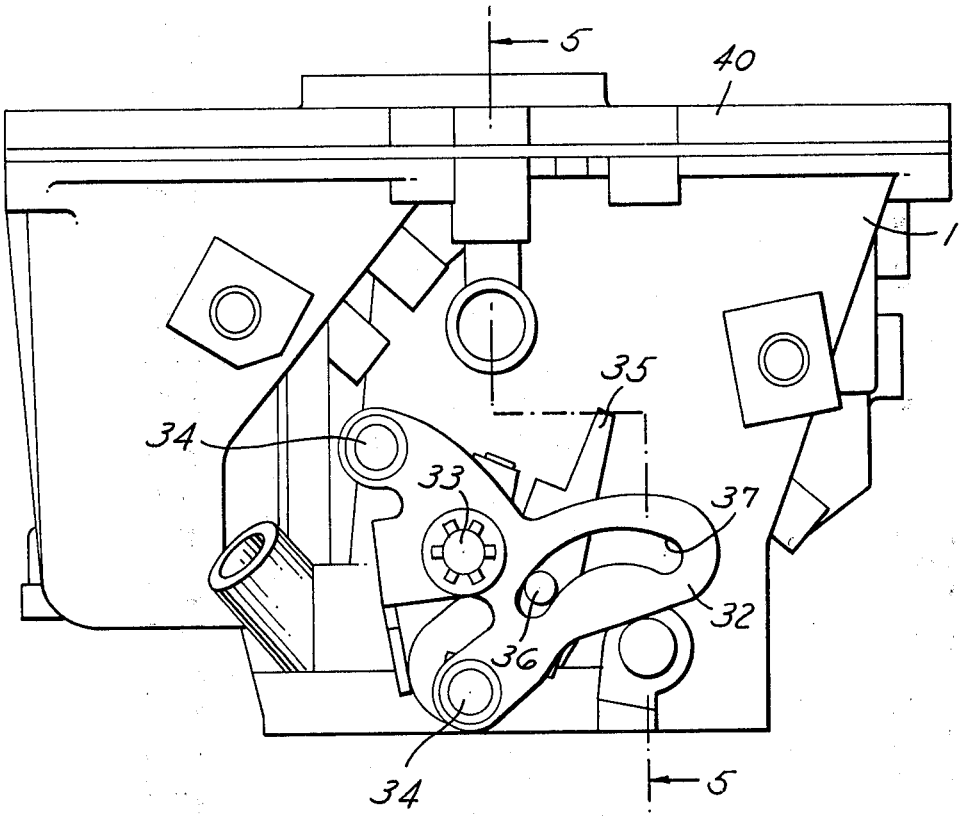
FIG. 3 is a side elevational view of the carburetor.

A throttle valve (FIG. 4) is positioned in the induction passage 2 downstream from the venturi member 15. The throttle valve comprises a plate 30 mounted on a rotatable shaft 31 for movement between the closed position shown and an open position, in which the plate is essentially vertical. Rotation of the plate 30 is effected by means of a linkage mounted on the exterior of the housing 1. As best seen in FIGS. 1 and 3, this linkage comprises a first lever 32 mounted for pivotal movement about an axis 33, and a second lever 35 mounted for pivotal movement about the axis of the throttle shaft 31. The first lever 32 carries two studs 34 by means of which the first lever can be connected to a conventional accelerator cable. The second lever 35 is rotatable with the throttle shaft 31 and is connected to the first lever 32 by a peg 36 on the second lever 35 which is received in a slot 37 in lever 32. The distance between the pivot axis 33 of the first lever and the slot 37 increases progressively along the length of the slot 37 so that equal incremental clockwise movements (as seen in FIG. 3) of the first lever 32 produce progressively larger clockwise movements of the second lever 35 and therefore of the throttle plate 30. As a result, finer control of the position of the throttle valve is obtained at small throttle openings.

The housing 1 is covered by a flat plate 40 (FIGS. 3 and 4) that is bolted to the housing 1. The plate 40 is a one-piece casting, and defines an air inlet orifice 41 aligned or registering with the induction passage 2. The plate also forms a closure for the open end of cavities 3 and 4 that form the fuel chamber and the recess for the venturi member 15. The plate 40 is sealed to the housing by means of a single gasket 43 that extends around the periphery of the housing 1 and across the dividing wall between the fuel chamber cavity 3 and the recess for the jet block 9.

Figure 4:
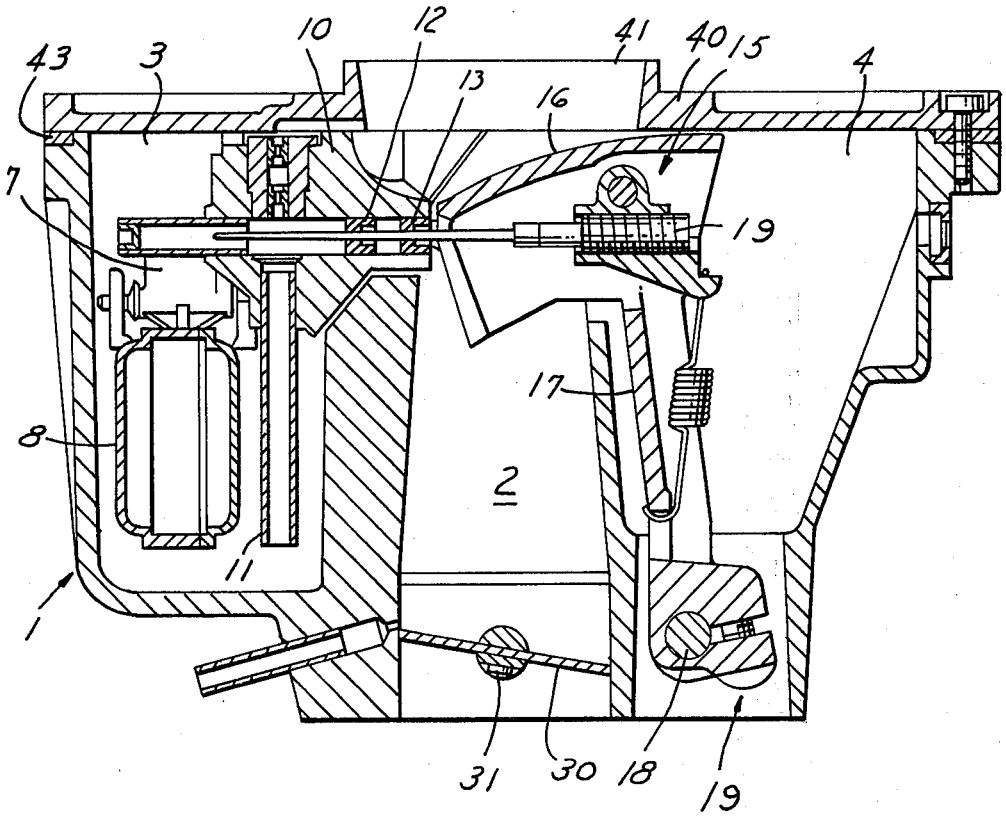
FIG. 4 is a vertical cross-sectional view taken along line 4—4 of FIG. 1.

The operation of the carburetor is as follows. In use, with the engine running and the throttle valve 30 open, air is drawn into the induction passage 2 through the inlet orifice 41 and passes through the venturi formed in part by the member 15. The reduced pressure formed at the edge of the valve 16 of the venturi member 15 by the increased velocity through the narrow opening draws fuel from the fuel chamber 3 up through pipe 11 through the jets 12, 13 and into the induction passage 2, the quantity of fuel supplied to the induction passage 2 being controlled by the position of metering needle 19. The level of the vacuum in the cavity 4 is applied to the vacuum motor 23 through passage 25. As the pressure in the manifold decreases, the air velocity through the small opening will increase. The vacuum motor 23, however, causes the venturi member 15 to move clockwise as seen in FIG. 4 about the axis of the layshaft 18 so that the cross-sectional area of the venturi in the induction passage 2 is therefore increased and the pressure at the venturi remains substantially constant.

Figure 6:
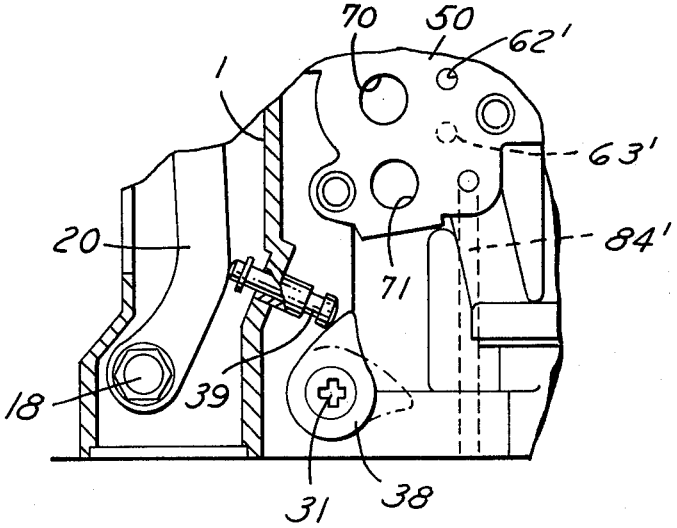
FIG. 6 is a partial vertical cross-sectional view taken along line 6—6 of FIG. 5.

Referring to FIG. 6, the end of the throttle shaft 31 opposite the linkage carries a cam 38 that is rotatable into engagement with one end of a pin 39 projecting through the wall of the housing 1 and axially slidable therein. When the throttle plate 30 is moved into its fully open position, as shown in full lines in FIG. 6, the cam 38 engages the pin 39, and moves the arm 20 anticlockwise. As a result, the venturi member 16 is moved away from the jet block 9. This condition allows the engine on which the carburetor is mounted to be cleared of fuel in the event of an ignition failure. Thus, by cranking the engine with the throttle fully open, air is drawn into the induction passage 2. However, the venturi will be of such large cross-sectional area that the flow of air through the venturi will not be sufficiently fast to draw fuel from the jet block 9. Unburned fuel in the cylinders and induction system of the engine will therefore be swept clear.

Figure 2:
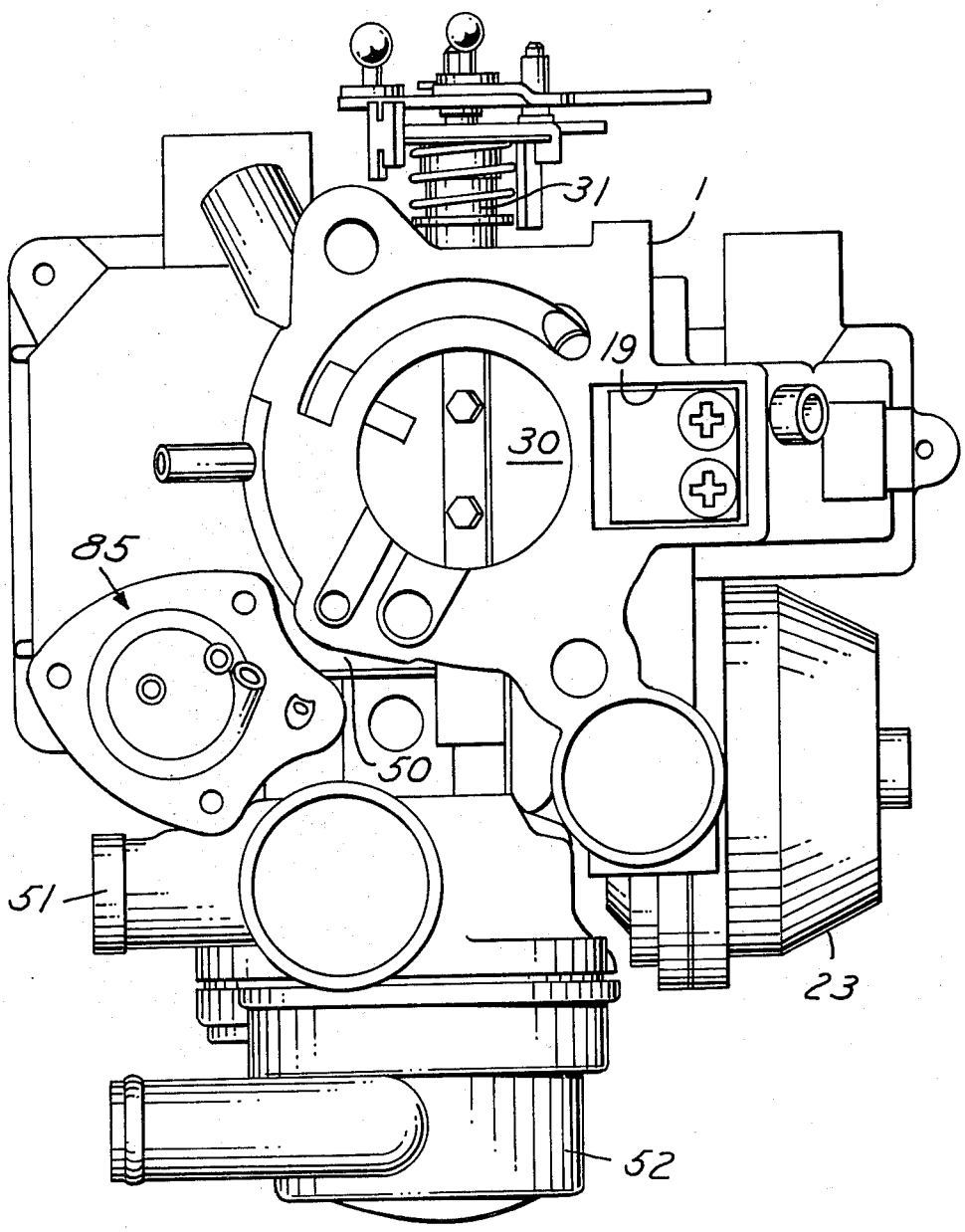
FIG. 2 is a view of the bottom of the carburetor looking up.
Figure 7:
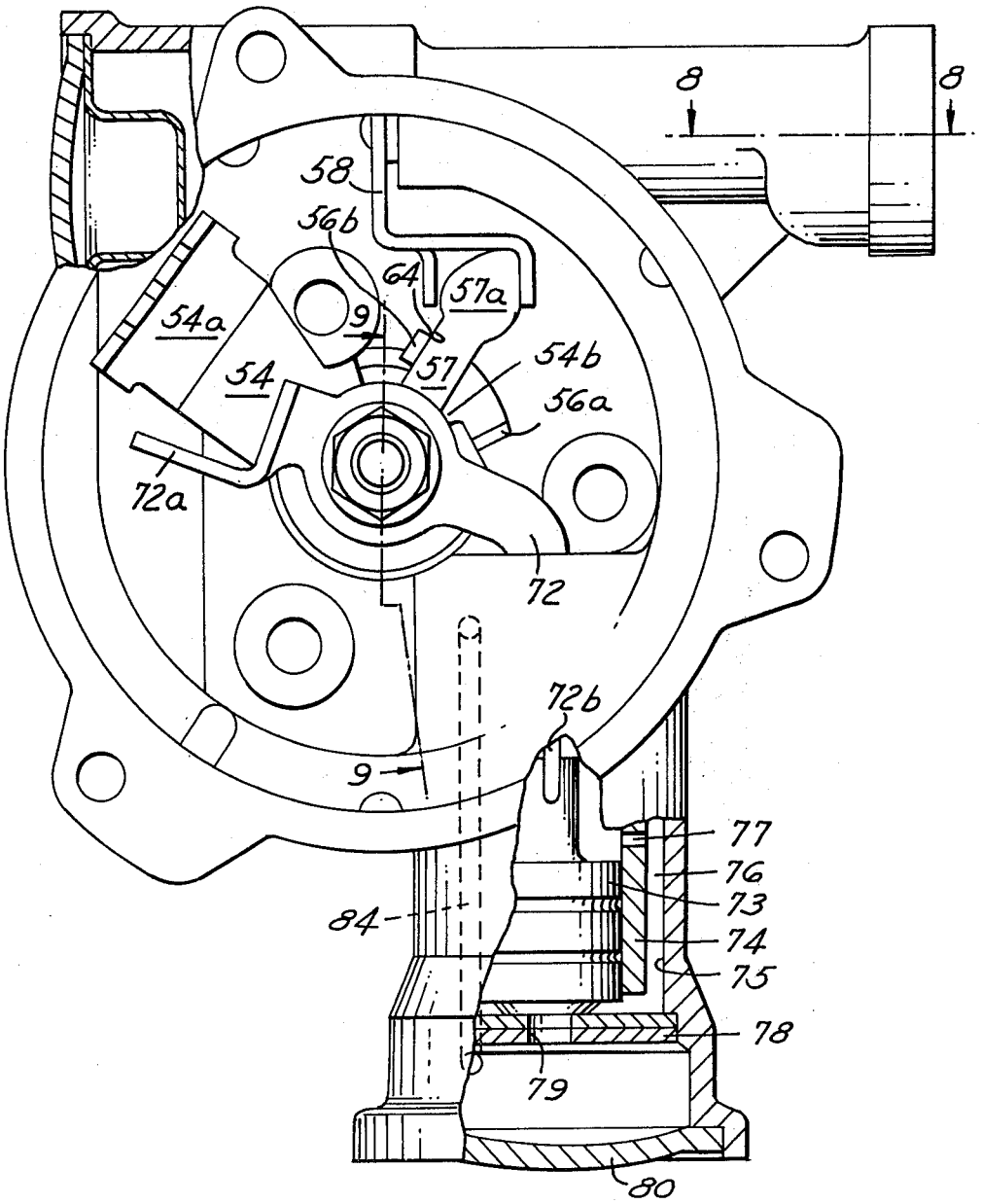
FIG. 7 is an end view of an automatic choke device mounted on the carburetor with parts broken away and in section.
Figure 8:
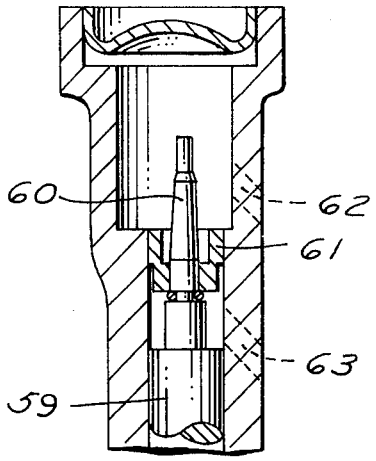
FIG. 8 is a cross-sectional view along line 8—8 of FIG. 7.
Figure 9:
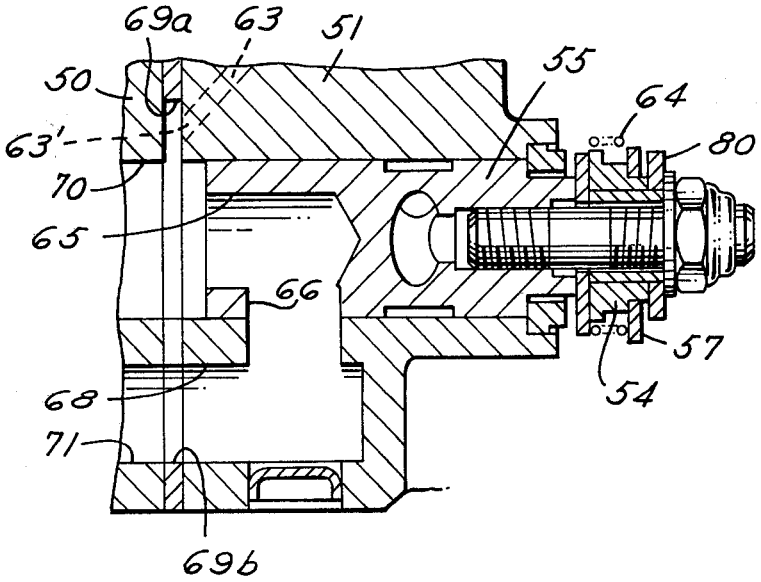
FIG. 9 is a cross-sectional view along line 9—9 of FIG. 7.
Figure 10:
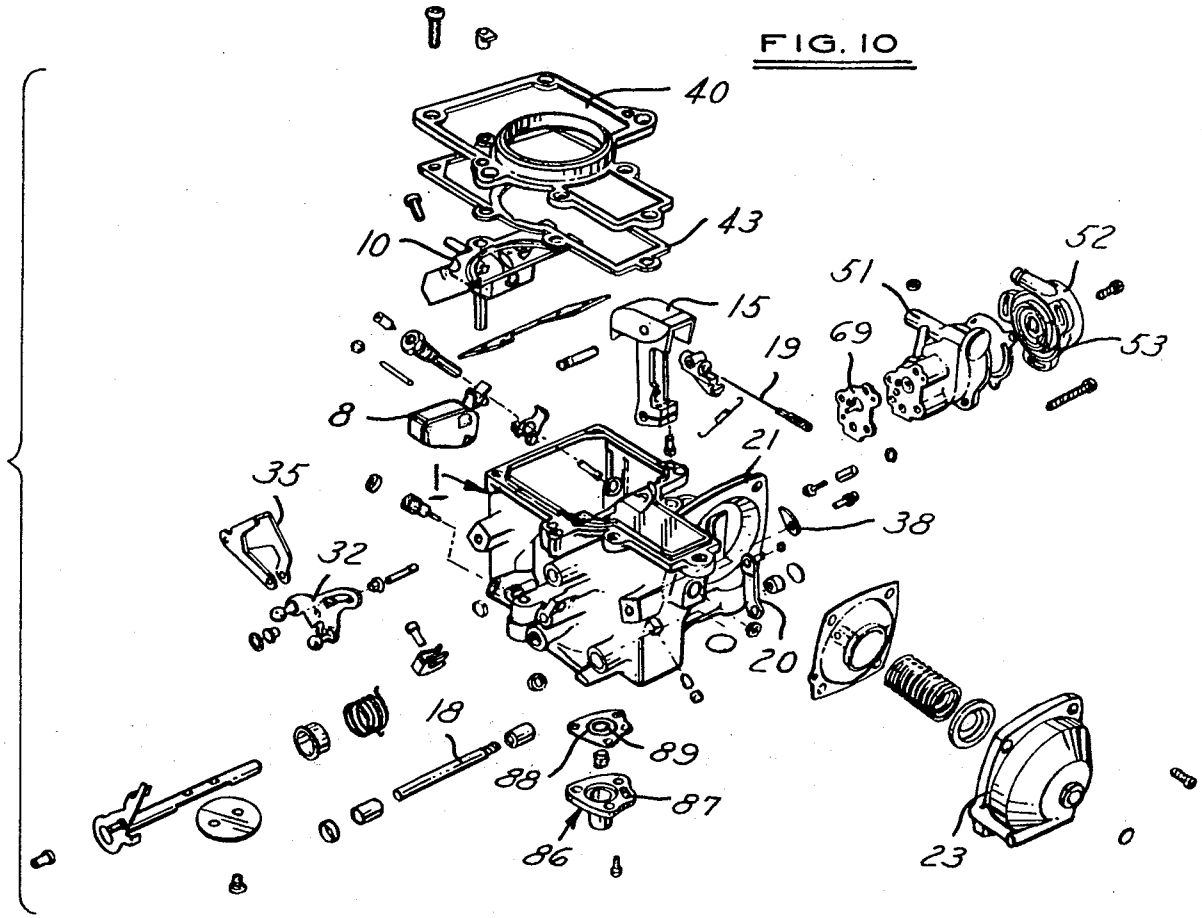
FIG. 10 is an "exploded" perspective view of the carburetor.

As seen in FIGS. 1 and 2, the housing 1 also incorporates an integral mounting 50 for an automatic choke device. The automatic choke device comprises a choke housing 51 and a water jacket 52. The water jacket 52 receives coolant water from the inlet manifold on which the carburetor is mounted. As best seen in FIGS. 10 and 7, the water jacket 52 houses a bimetallic spring coil 53, the outer end of which is connected to one leg 54*a* of a bell-crank lever 54. The bell-crank lever 54 is fixed to a spindle valve 55 (FIG. 9) that is rotatably mounted in a bore in the choke housing 51. The other leg 54*b* of the bell-crank lever 54 carries a U-shaped tab 56, the arms of which loosely embrace an operating lever 57 that is mounted on the end of the spindle valve 55 for rotation relative thereto. A rounded head 57*a* of the lever 57 is received in the yoke end of a bracket 58 that is mounted on one end of a rod 59 (see FIG. 8) slidable in a cylindrical bore in the choke housing 51. The other end of the rod 59 is shaped to form a metering needle 60 that engages in a metering orifice 61 in the bore to control the flow of fuel from an inlet passage 62 in the choke housing 51 on one side of the orifice 60 to an outlet passage 63 in the choke housing on the other side of the orifice 61. If desired, the metering needle 60 may be floatingly mounted on the rod 59 to reduce the risk of the needle 60 jamming within the orifice 61. The inlet passage 62 receives fuel from a supply passage 62 (FIG. 6) in the casting 1 that has its outlet in the mounting 50 and which communicates with the fuel supply line 6. The outlet passage 63 terminates opposite the mounting 50 as indicated at 63 in FIG. 6.

A coil spring, one end of which is shown at 64 (FIG. 7), acts between the bell-crank lever 54 and the operating lever 57 biasing the levers 54, 57 apart in anti-clockwise and clockwise directions, respectively, as seen in FIG. 7. In the position illustrated in FIG. 7, the spring 64 is compressed so that the lever 57 is urged clockwise, the rod 59 is reciprocated fully to the right, and the metering needle 60 in FIG. 8 closes the orifice 61, anti-clockwise movement of the lever 54 being resisted by the bimetallic coil spring 53.

The spindle valve 55 (FIG. 9) has an axial bore 65 that communicates at its inner end with a radial bore 66. Rotation of the spindle valve 55 about its axis brings the radial bore 66 into and out of registry with an outlet passage 68 in the choke housing 56.

The choke housing is sealed to the mounting 50 by means of a gasket (FIG. 10) that is slotted at **69*a* (FIG. 9) to provide communication between the outlet passage 63 from the metering orifice 61, the axial bore 65 in the spindle valve 55, and an internal passage 70 in the housing 1 that communicates with the induction passage 2 below the venturi but above the throttle plate 30. A hole 69*b* in the gasket 69 also effects communication between the outlet passage 68 in the choke housing 56 and a further internal suction passage 71 in the housing 1 communicating with the induction passage 2** downstream of the throttle valve.

In operation, when the engine is cold, the bimetallic coil spring 53 in FIG. 10, moves the lever 54 anti-clockwise from the position shown in FIG. 7. The arm **56*a* of the tab 56 then engages the lever 57 to displace it anti-clockwise from the position shown, thus moving bracket 58 and opening the metering orifice 60. The spindle valve 55 is also rotated by movement of lever 54 so that the radial bore 66 registers with the outlet passage 68. Reduced pressure or vacuum in the induction passage downstream of the throttle valve 31 therefore draws an air/fuel mixture through the internal passage 71 in FIG. 9 from the induction passage 2 upstream of the throttle valve via the passage 70, the axial bore 65, the radial bore 66, and the outlet passage 68. The flow of mixture into the axial bore 65 draws fuel through the slot 69*a* in the gasket 69 from the inlet passage 62 via the metering orifice 61 and the outlet passage 63 into the axial bore 65**. As a result, the mixture entering the inlet manifold is enriched with fuel.

In an alternative embodiment, not shown, the fuel from the metering orifice would not be mixed with the fuel/air mixture in the axial bore 65 via the slotted gasket 69. Instead, the mounting 50 could be provided with an additional fuel passageway that would communicate at one end with the outlet passage 63 and at its other end with the jet block 9 to introduce the additional fuel between the two jets 12, 13. This arrangement would have the advantage that the flow of additional fuel would be modulated by the venturi in the induction passage rather than by the flow of fuel/air mixture into the axial bore 65 as in the embodiment described.

As the engine temperature increases, the bimetallic coil 53 moves the lever 54 clockwise (FIG. 7). The spring 65, acting between the levers 54 and 57, holds the lever 57 in engagement with the arm **56*a* of the tag 56 so that the lever 57 also moves clockwise. This in turn reciprocates the rod 59 and closes the metering orifice 61. At the same time, the spindle valve 55 (FIG. 9) is rotated with the lever 54 so that the radial bore 66 is moved out of registry with the outlet passage 68. The metering orifice 61 and the outlet passage 68 are not, however, closed simultaneously. Thus, when the operating lever 56 reaches the position in which the orifice 61 is closed, the lever 54 continues to rotate clockwise as the engine warms up, until the opposite arm 56*b* of the tab 56 engages the operating lever 57. During this movement, the radial bore 66 is still partly in registry with the outlet passage 68 so that additional air/fuel mixture from downstream of the venturi bypasses the throttle plate 30 via the automatic choke device. As a result, the automatic choke feeds an initially fuel-rich mixture to the induction passage 2 to facilitate starting and cold-running of the engine. While the engine is warm, but not at its maximum operating temperature, the choke device supplies additional fuel/air mixture to the engine so that the engine has an increased idle speed. When the engine reaches its operating temperature, the metering orifice 61 is fully closed and the radial bore 66 in the spindle valve 55 is fully out of registry with the outlet passage 68. Neither fuel nor air, therefore, is fed into the induction passage 2** from the automatic choke device.

Although additional fuel is required for starting the engine and during initial warm-up, the amount of additional fuel needed varies with the load on the engine. Thus, more additional fuel will be required under high load conditions, e.g., when accelerating, than under low load conditions. In order to reduce the quantity of fuel added to the engine at low loads, a further operating lever 72 (FIG. 7) is mounted on the end of the spindle valve 55 and is rotatable thereon. One arm **72*a* of the lever 72 is arranged to engage the arm 54*a* of the bell-crank lever 54. The other arm 72*b* of the lever 72 is attached to a piston 73 that is reciprocable in a tube 74 that is mounted at one end within a cylindrical bore 75 in the choke housing. The part of the bore 75 surrounding the opposite end of the tube 74 is of larger diameter than the tube 74 so that an annular passage 76 is formed between the tube 74 and the bore 75. A series (only 1 shown) of radial bores 77 are formed in the tube 74 at intervals along its length. The movement of the piston 73 in the tube 74 is limited by a plate 78 having a central bore 79. The bore 75 is sealed by a cap 80. The space between the plate 78 and the cap 80 communicates with vacuum in the induction passage 2 downstream of the throttle valve 30 via a passage 81 in the choke housing 56, a passage 82 in the casting 1 (FIG. 6) and a slot in the gasket (not shown) that seals the casting 1 in the manifold on which it is mounted. The side of the piston 73 adjacent the arm 72*b* is exposed to atmospheric pressure. At low loads, the vacuum in the induction passage below the throttle valve is high. The piston 73 is drawn downwardly (as seen in FIG. 7) thus rotating the lever 72 clockwise (as seen in FIG. 7). When the engine is cold, this clockwise movement of the lever 72 will rotate the bell-crank lever 54 against the bias of the bimetallic coil spring, reducing the amount of fuel and air supplied by the automatic choke device. As the piston travels down the tube 74, it uncovers progressively more of the radial bores 77 so that increasing quantities of air bypass the piston 73 through the annular space 76 and the bore 79. Finer control over the position of the piston 73 is thereby obtained. When the engine load is increased, the piston 73 and the lever 72*b* are returned to the positions set by the bimetallic coil spring 53**, thus supplying the additional fuel.

A further mounting 85 (FIG. 2) for an acceleration pump 86 (FIG. 10) is formed integrally with the casting 1 at the base thereof adjacent the outlet of the induction passage 2. The acceleration pump 86 is a diaphragm pump of conventional construction comprising a housing 87 defining a vacuum chamber that is maintained at the pressure of the induction passage 2 below the throttle plate 30. A diaphragm 88 separates the housing 87 from the mounting 85. The mounting 85 defines a fuel chamber 89 that receives fuel from the fuel pump and communicates with a fuel passage that extends upwardly through the housing 1 and emerges at a jet 90 (FIG. 1) adjacent the venturi in the induction passage. In order to prevent fuel from being drawn upwardly through this fuel passage by the venturi, the passage is vented to atmospheric pressure.

The diaphragm 88 is spring biased in the upward direction. When the vacuum in the inlet manifold is high, the diaphragm overcomes the bias of the spring and draws fuel into the fuel chamber 89 through a non-return valve. When the vacuum in the inlet manifold is low, i.e., when the throttle plate 30 is suddenly opened, the diaphragm is biased upwardly by the spring to pump a small quantity of fuel through a non-return valve up the fuel passage and out of the jet 90, thus ensuring that the sudden drop in the vacuum at the manifold does not cause an undesirably lean fuel/air intake to be introduced into the engine.

Manufacture and assembly of the carburetor is considerably facilitated by the fact that the main body of the carburetor is a two-piece assembly composed of the housing 1, which mounts the valve, float chamber 3, jet block 9, and the venturi member 15, and the closure plate 40, which acts simply as a cover for the housing 1. Since the housing 1 is a one-piece casting, the relative positions of the induction passage 1, the cavities 3 and 4 and the mounting for the vacuum motor 23 are all accurately defined, and the mountings for the fuel jet block 9, the layshaft 18, and the throttle plate 30, and their associated fuel and air passages in the carburetor can be formed accurately during one series of machining operations, which is performed on a single component. Similarly, since the mountings for the automatic choke device and the acceleration pump are also formed integrally with the casting 1, the fuel and air passages for these components can be machined in the same series of operations.

On the other hand, the cover plate 40, which is an integral one-piece casting of simple flat form, does not incorporate mountings for any of the moving parts of the carburetor or the associated fluid supply passages. The jet block 9, throttle valve 30, and venturi member 15, therefore, all operate wholly within the confines of the housing 1 and form a single sub-assembly therewith. Consequently the relative positioning of these components can be controlled to within a relatively wide tolerance since no account need be taken of the variation in relative positioning which would otherwise be caused by manufacturing tolerances if each component were mounted in a separate sub-assembly.

The formation of the float chamber and the recess for the venturi member 15 with upwardly opening cavities 3, 4 closed by the cover plate 40 also facilitates servicing of the carburetor because access to the float chamber and venturi member can be achieved simply by removing the cover plate 40. Moreover since the cover plate 40 includes none of the moving parts or fluid passageways of the carburetor, removal of the plate 40 will not disturb the adjustments of the carburetor.

We claim:

1. A downdraft carburetor consisting of a one-piece unitary casting supporting the working components of the carburetor, and a non-supporting cover with an opening defining the upper end of an air induction passage, the casting having cavities and walls defining a centrally located induction passage aligned with the opening in the cover, a first cavity defining a float bowl to one side of the induction passage, an opening in the wall of the induction passage connecting the float bowl and induction passage for the passage of fuel therebetween, a one-piece fuel assembly jet block mounted in the opening consisting of a fuel supply inlet, a float, a fuel induction tube, a fuel passage, and a pair of fuel jet orifices in the fuel passage adapted to receive a fuel metering needle slidably therein, a second cavity on the opposite side of the induction passage and containing a movable wall, the induction passage containing a throttle valve at one end and a venturi-like portion adjacent the other end defined in part by the movable wall to together define a variable area venturi, the movable wall having secured thereto a fuel metering needle having an end movable and receivable within the orifices in the fuel passage to be capable of varying fuel flow upon movement of the movable wall to vary the venturi size, means connecting the movable wall cavity to the induction passage at a point between the throttle valve and venturi so as to subject the second cavity to the level of pressure in the induction passage, and a vacuum servomotor connected to the movable wall and mounted on the casting and communicating with the second cavity for moving the movable wall in response to changes in level of the pressure in the second cavity to vary the venturi size and fuel flow.

* * * * *